US005999765A

United States Patent [19]

Tomita

[11] Patent Number: 5,999,765

[45] Date of Patent: Dec. 7, 1999

[54] IMAGE FORMING APPARATUS AND METHOD THEREFOR

[75] Inventor: Kan Tomita, Tokyo, Japan

[73] Assignee: Ricoh Company, Ltd., Tokyo, Japan

[21] Appl. No.: 09/122,864

[22] Filed: Jul. 27, 1998

[30] Foreign Application Priority Data

Jul. 25, 1997 [JP] Japan ..... 9-199665

[51] Int. Cl.[6] ..... G03G 21/00

[52] U.S. Cl. ..... 399/69; 399/45; 399/81

[58] Field of Search ..... 399/81, 45, 69; 345/903, 173–175

[56] References Cited

U.S. PATENT DOCUMENTS 5,390,005 2/1995 Kimoto et al. .
5,459,554 10/1995 Shiraishi .
5,463,448 10/1995 Wilson et al. .
5,565,964 10/1996 Tashiro et al. .
5,614,993 3/1997 Smith et al. ..... 399/81
5,642,185 6/1997 Altrieth et al. ..... 399/81
5,717,977 2/1998 Suzuki et al. ..... 399/45
5,754,924 5/1998 Yamada ..... 399/81
5,774,759 6/1998 Tanaka ..... 399/8

*Primary Examiner*—Richard Moses
*Attorney, Agent, or Firm*—Oblon, Spivak, McClelland, Maier & Neustadt, P.C.

[57] ABSTRACT

An image forming apparatus includes an image forming device that forms a required image on a paper. A paper-feeding tray is capable of advancing and retreating, and is contained in a main body of the image forming apparatus, wherein a plurality of papers can be stacked thereon. A conveying path conveys the paper in the paper-feeding tray to the image forming device. A setting device sets a sort-of-paper when a special paper other than a plain paper is stacked in the paper-feeding tray. A setting device is provided in an operation panel. A setting device can set the sort-of-paper with a single key operation provided in the operation panel, when only one paper-feeding tray is provided with a separation paper-feeding mechanism which can feed paper, including special paper, regardless of the sort-of-paper, and when the special paper is stacked in the paper-feeding tray.

24 Claims, 14 Drawing Sheets

IMAGE FORMING APPARATUS AND METHOD THEREFOR

BACKGROUND OF THE INVENTION

1. Field of the Invention

The present invention relates to an image forming apparatus such as a copying machine, a printer, etc.

2. Discussion of the Background

Recently, in an image forming apparatus, a so-called front loading method having a front paper-feeding tray capable of advancing and retreating towards a front side of the image forming apparatus is becoming common. "Plain paper" that can be fed from the front paper-feeding tray has a thickness of 90 kg in Renryo (a unit of thickness of a paper represented by weight of 1000 stacked papers in each area of 788 mm×1091 mm provided by Japanese Industrial Standard) or less. In addition, special type papers such as a carton paper (hereinafter referred to as a "carton") that exceeds the aforementioned thickness, an envelope, a post card, an exfoliation paper, OHP paper (transparency film for an overhead projector), and other papers that are relatively thick can be fed by a by-pass paper-feeding device attached outside of a main body of the image forming apparatus, which is referred to as a manual paper feeder.

Generally, the front paper-feeding tray can contain about 250 to 1000 sheets of plain paper, and a separation paper-feeding mechanism such as a corner-pick separation device capable of separating paper even when a number of contained papers is large, which is provided at a relatively low cost, a friction pad, or the like, can also be used.

On the other hand, it is assumed that the manual paper feeder is generally used for special type papers, such as a carton having a low frequency of use, a special paper such as a paper for an overhead projection, a non-standard size paper, or the like, for a provisional use. There are two types of manual paper feeders, one that can hold only one paper at a time, and another one that can hold a plurality of papers at a time. The former is quite complex to use in requiring setting papers one by one, even though it is provided at a relatively low cost. The latter requires an expensive separation paper-feeding mechanism since several cartons or special papers may be fed one after another. In addition, the latter is not always advantageous in operation since, in a case of a carton as an example, only approximately one third of the number of plain papers can be set at one time. However, the number of users of the manual paper feeder having a high frequency of use cannot be disregarded, and the number of one time uses is large. Therefore, the manual paper feeder does not have sufficient specification even though the manual paper feeder can feed plenty of papers. On the contrary, many of the users of the image forming apparatus having the manual paper feeder capable of feeding plenty of papers sparingly use the manual paper feeder, which has an expensive mechanism.

Accordingly, in light of solving the problems of the aforementioned manual paper feeder, the present inventor thought that if a FRR (Feed Reverse Roller) or similar sophisticated separation paper-feeding mechanism is mounted on a front paper-feeding tray, functions of a manual paper feeder can be executed by the front paper-feeding tray. Consequently, availability for a sort-of-paper from the front paper-feeding tray expands to a great extent, and the manual paper-feeding function is not required. Further, when the front paper-feeding tray is used for plain paper, higher reliability of paper-feeding quality can be obtained.

On the other hand, many background image forming apparatus are provided with a peripheral device for paper-discharging (hereinafter referred to as a paper-discharging peripheral device). The paper-discharging peripheral device may be a sorter, a mail box, a finisher, a reversing unit for a duplex copy, or the like. In other words, the paper-discharging peripheral device discharges a paper on which an image is formed by an image forming apparatus. Since there scarcely is a request for using a carton or special paper in such a peripheral device, paper-feeding performance for paper other than plain paper is not assured because the paper-discharging peripheral device is manufactured at low cost. Further, the manual paper feeder is surely used when the carton or special paper other than the plain paper is to be fed, and accordingly a controller of the image forming apparatus controls not to convey the carton or special paper to the paper-discharging peripheral device from the manual paper feeder. Such a control is easy because the controller can easily recognize the existence or absence of paper from the manual paper feeder.

However, in a case of a construction that feeds the aforementioned carton or special paper as well as the plain paper with the front paper-feeding tray, the plain paper should be discharged to the paper-discharging peripheral device, whereas the carton or special paper should not be discharged to the paper-discharging peripheral device because paper jamming may tend to occur at the paper-discharging peripheral device. In addition, there is a problem that the user may not understand the cause of the paper jamming.

Further, in a case of manual paper-feeding, a setting temperature of a heat fixing device may be changed from that for the plain paper or an image forming condition may be changed from that for the plain paper, to improve a fixing property for the special paper, e.g. carton, or to maintain image quality. However, a kind of paper fed from the front paper-feeding tray cannot be distinguished when a background paper-feeding device is used. Accordingly, the setting temperature of the heat fixing unit and the image forming condition cannot be changed according to the type of paper, and a problem of insufficient fixing or poor image quality may occur.

SUMMARY OF THE INVENTION

It is an object of the present invention to realize an appropriate image formation operation corresponding to a sort-of-paper at low cost, even when a paper feeding tray capable of advancing and retreating, which is contained in a main body of an image forming apparatus, includes a manual paper feeding function.

It is another object of the present invention to enable an appropriate removal of jammed paper, even when a manual paper feeding function includes a paper feeding tray capable of advancing and retreating, which is contained in a main body of an image forming apparatus.

It is still another object of the present invention to prevent an insufficient fixing of an image, even when a manual paper feeding function includes a paper feeding tray capable of advancing and retreating, which is contained in a main body of an image forming apparatus.

It is still another object of the present invention to prevent a poor image quality, even when a manual paper feeding function includes a paper feeding tray capable of advancing and retreating, which is contained in a main body of an image forming apparatus.

These and other objects are achieved by the present invention.

BRIEF DESCRIPTION OF THE DRAWINGS

A more complete appreciation of the present invention and many of the attendant advantages thereof will be readily obtained as the same becomes better understood by referring to the following detailed description when considered in connection with the accompanying drawings, wherein.

DESCRIPTION OF THE PREFERRED EMBODIMENT

Figure 1A:
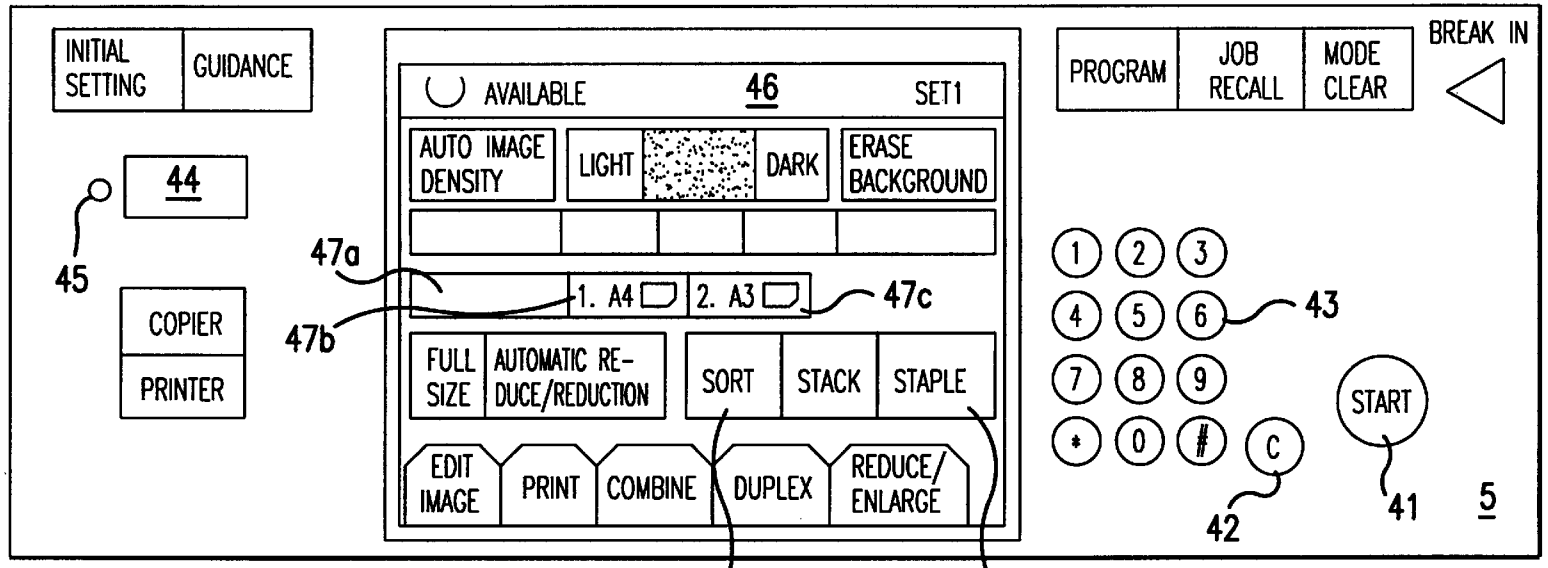
FIGS. 1A and 1B are top plan views of an operation panel in a first example of the present invention.
Figure 1B:
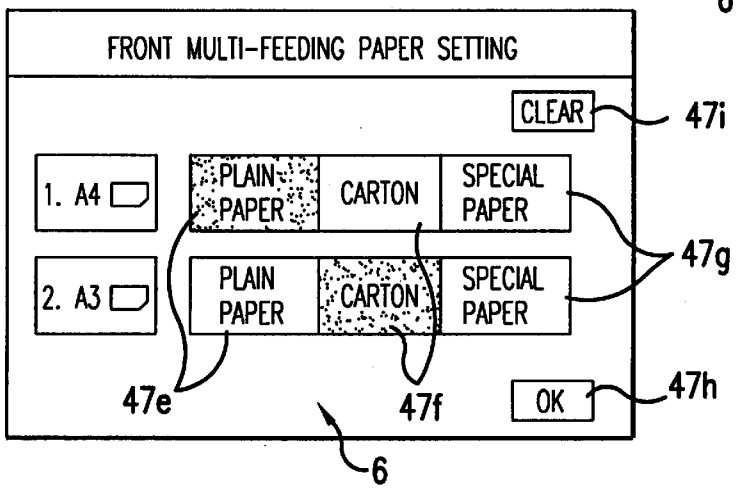
Figure 2:
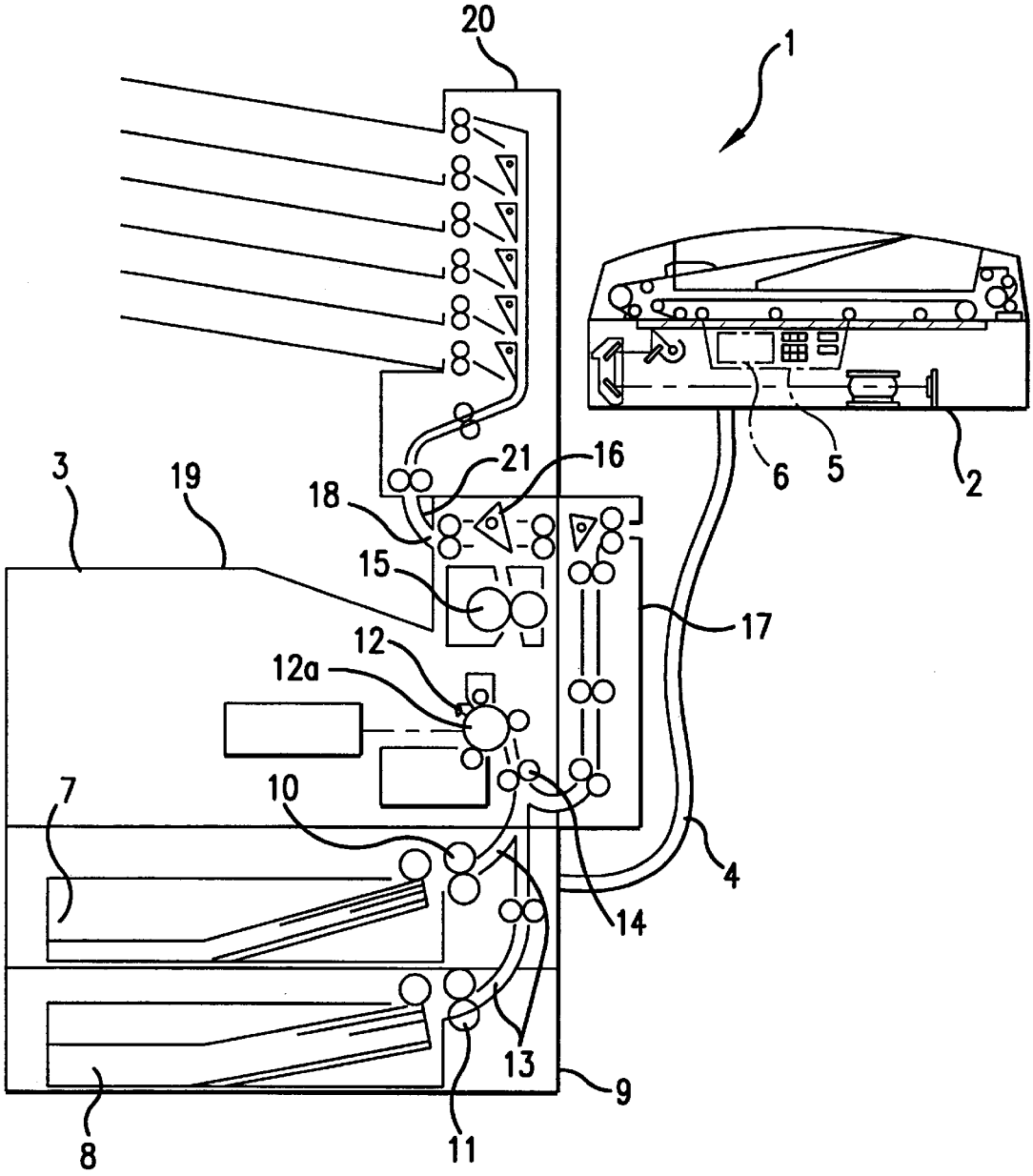
FIG. 2 is a vertical section showing a schematic construction of a digital copying machine.
Figure 3:
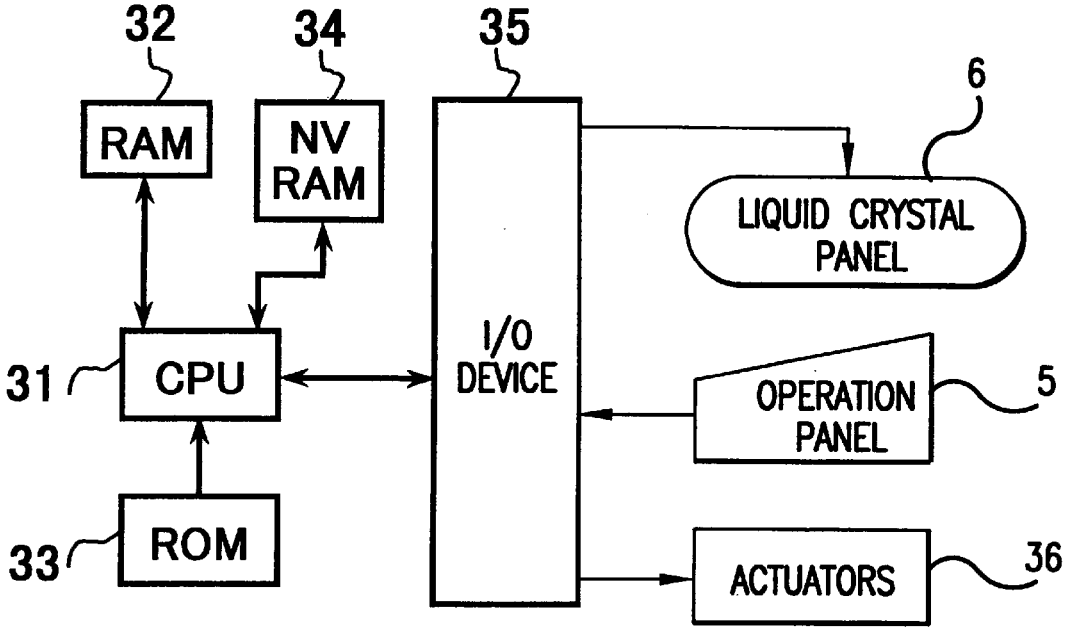
FIG. 3 is a block diagram showing a schematic construction of a control for a digital copying machine.

A first example of a preferred embodiment of the present invention is explained referring to FIGS. 1 through 3. This example is applied to a digital copying machine 1 as an example of an image forming apparatus. FIG. 2 is a vertical section showing a schematic construction of this digital copying machine 1.

First, the digital copying machine 1 is composed of a scanner section 2, that can be separately constructed, and a plotter section 3; the scanner 2 and the plotter 3 are connected by a cable 4. An operation panel 5 for operating the digital-copying machine 1 is mounted on the scanner section 2. A liquid crystal panel 6 for displaying a predetermined message or the like with a touch panel structure is provided at a part of the operation panel 5.

Two front paper-feeding trays, for example an upper tray 7 and a lower tray 8, are located beneath the plotter section 3, i.e., front paper-feeding trays 7 and 8 are mounted. The front paper-feeding trays 7 and 8 contain papers in a stacked state and are so-called front loading type paper-feeding trays that are slidably held in an advancing and retreating direction to the image forming apparatus 9. Accordingly, a direction of the paper to be fed from the front paper-feeding trays 7 and 8, and the advancing and retreating direction of the front paper-feeding trays 7 and 8, are perpendicular. These front paper-feeding trays 7 and 8 have respective separation paper-feeding mechanisms 10 and 11 based on a FRR (Feed Reverse Roller) method which has a function capable of separation paper-feeding in a case of feeding not only plain paper but also special type papers such as a carton or other special paper. Further, an exit point from the front paper-feeding trays 7 and 8 and an input of an image forming device 12 is connected by a paper-feeding path 13, and a registration roller 14 is mounted on the paper-feeding path 13. Paper fed from the front paper-feeding trays 7 or 8 is conveyed to the image forming device 12, at a timing controlled by the registration roller 14.

In the aforementioned image forming device 12, a latent image is formed on a photoconductive element 12*a*. The latent image is developed with toner so as to convert the latent image to a visible image, and the visible image is then transferred to the paper fed from the aforementioned registration roller 14. The paper on which the visible image is transferred to is then conveyed to a heat fixing device 15. The heat fixing device 15 can be a heat roller type fixing device, and fixes the (visible) toner image onto the paper with heat and pressure.

The paper discharged from the heat fixing device 15 alternatively selects a right or left discharging direction as shown in FIG. 2, by a selecting pick 16 mounted at a position just after a discharging exit of the heat fixing device 15. The paper discharged to the right side of the selecting pick 16 in FIG. 2 is conveyed to a duplicating reverse unit 17 as one paper-discharging peripheral device, and such paper is then re-fed to the paper-feeding path 13 upstream of the registration roller 14. An image can then be formed on a backside of the paper in this aforementioned process. The paper discharged to the left side of the selecting pick 16 in FIG. 2 is discharged from a main body paper-discharging section 18 towards an outside of the main body. A paper-discharging tray 19 that receives the paper discharged from the main body paper-discharging section 18 is mounted on an upper part of the image forming apparatus 9.

A sorter 20, which is also a paper-discharging peripheral device, is disposed on an upper part of the main body paper-discharging section 18, and the paper discharged from the main body paper-discharging section 18 is selectively led into the sorter 20 by an open/close motion of an entrance guide plate 21 mounted on the sorter 20. A paper sorting is carried out at the sorter 20.

FIG. 3 is a block diagram showing a construction of the control system of the aforementioned digital-copying machine 1. This control system includes a CPU 31 to which a RAM 32, a ROM 33, and a non-volatile memory (NVRAM) 34 are connected. Further, respective kinds of well-known actuators 36 that control respective kinds of motors and the like in order to, for example, drive rollers for conveying the paper from the aforementioned registration roller 14 to the paper-discharging tray 19, in addition to the operation panel 5 including the liquid crystal panel 6, are connected to the CPU 31 via an I/O device 35. Furthermore, other respective kinds of sensors and actuators (not shown in FIG. 3) are connected to the CPU 31. Respective kinds of programs for controlling respective sections of the digital copying machine 1 and the fixed data are stored in the aforementioned ROM 30.

FIG. 1A is a top plan view showing a construction of the operation panel 5 in a copy-ready state. A sort-of-paper setting key 44 is provided thereon, in addition to ordinary keys such as a start key 41 that instructs a start of copying operation on the operation panel 5, a clear/stop key 42, and a ten-key pad 43 for setting a number of copies or the like. By a side of this sort-of-paper setting key 44, an indication lamp 45 composed of a LED is disposed. Further, the liquid crystal panel 6 is disposed at a center part of the operation panel 5. A display part 46 displays respective kinds of messages, and respective kinds of function keys 47 select functions in each image frame on the display based on a touch panel construction in an area of the image frame in this liquid crystal panel 6. An automatic paper selecting key 47*a*, an upper front paper-feeding tray selecting key 47*b*, a lower front paper-feeding tray 47*c*, sorter related keys such as "sort", "stack", "staple" or the like 47*d*, and the like, are provided at a fundamental image frame in a copy-ready state on the operation panel shown 6 in FIG. 1A as function keys 47. Hereupon, the selecting keys 47*a* through 47*c* function as a paper selecting device, and sorter related key 47*d* functions as a paper discharge selection device.

FIG. 1B is a top plan view showing an image frame of the liquid crystal panel 6 positioned at one-step below a position that appears by selecting (i.e., pressing down) the sort-of-paper setting key 44 in a state shown in FIG. 1A. Three kinds of sort-of-paper keys, 47*e*, 47*f*, 47*g* are respectively provided for "plain paper", "carton", and "special paper" for each of the front paper-feeding trays (the paper-feeding trays 7 and 8). An "OK" key 47*h* and a "clear" key 47*i* are also provided. All the keys mentioned above are provided as function keys 47 for a "front multiple paper-feeding sort-of-paper setting" mode in this image frame of the liquid crystal panel 6. Hereupon, a carton and a special paper refer to a special type paper in this example. Therefore, both of the carton and special paper may not always be separated from each other and may be combined into one stack of papers as the special type paper. Further, the sort-of-paper setting key 44 and the sort-of-paper keys 47*f* and 47*g* function as a setting device in the present invention.

In this construction, for example, in a case of stacking the carton as a special paper in the lower front paper-feeding tray 8, when the sort-of-paper setting key 44 is pressed down, and the sort-of-paper key 47*f* as the "carton" key corresponding to the paper-feeding tray (front paper-feeding tray 8) is pressed down, making the "front multi-feeding paper setting" appear as shown in FIG. 1B, the required setting operation is completed. When the "OK" key 47 is pressed down, or the sort-of-paper setting key 44 is again pressed down, the entire setting operation is completed and the image frame returns to the copy-ready state as shown in FIG. 1A. In the copy-ready state, if the sort-of-paper key 47*f* or 47*g* for the "carton" or the "special paper" respectively regarding either the front paper-feeding tray 7 or 8 is pressed down and set, it is reported that at least a special type paper of a carton is set by lighting up the indication lamp 45 by the side of the sort-of-paper setting key 44. Further, at an image frame for a "front multi-feeding paper setting" mode in FIG. 1B, a size and a direction of the paper stacked on each of the front paper-feeding trays 7 and 8 at present are displayed, and the paper that is selected by pressing one of the sort-of-paper keys 47*e*, 47*f*, and 47*g* is also displayed with highlighting. The display in FIG. 1B indicates that the front paper-feeding tray 7 stacks the plain paper, and that the front paper-feeding tray 8 stacks the carton in an example shown in FIG. 1. The plain papers are indicated at both of the displays at an initial setting.

The sort-of-paper information regarding the paper in the front paper-feeding trays 7 and 8 that is thus set on the basis of the operation of the sort-of-paper setting key 44 and the sort-of-paper keys 47*e*, 47*f*, and 47*g* can then be stored in the non-volatile memory (NVRAM) 34. The information is kept regardless of whether or not the power switch is turned on or off. In addition, CPU 31 can control an image forming operation corresponding to the sort-of-paper information that is stored in the non-volatile memory 34, while an actual copying operation is performed on the basis of an operation of the start key 41. A detailed example of a control of the CPU 31 is explained in an example described later for several cases. However, since the CPU 31 can recognize the sort-of-paper information on the basis of the setting, even when the special paper is set in the front paper-feeding tray 7 or 8, a corresponding control can be performed.

Hereupon, in this embodiment, a setting for the special paper can be performed on the operation panel 5, and accordingly, a proper operation for the setting operation can be performed by a user. Especially, the user can continuously perform the setting of the copying condition in a case of changing the sort of the paper at the operation panel 5 after setting the sort of the paper.

On the other hand, in this embodiment, a final image frame for setting the sort of the paper is prepared as an image frame located one layer below the display as shown in FIG. 1B. Since it is not required to change the image frame to the position more than two layers of the liquid crystal panel 6, the operation efficiency for setting the sort of the paper is not significantly lowered. Namely, since the manual paper-feeding function is added to the front paper-feeding trays 7 and 8 decommissioning that at the manual paper feeder, the operation efficiency should be kept as well as possible, and this object is achieved.

Further, a canceling operation after once setting the special type paper, such as the carton or other special paper, can be performed by pressing down on the sort-of-paper key 47*e* for the "plain paper". However, in this embodiment, when the "clear" key 47*i* is pressed down, both of the front paper-feeding trays 7 and 8 can be set to be changed over to the plain paper side. Hereupon, the "clear" key 47*i* is set to a function canceling device. Unless such a canceling operation is intentionally performed, the state set before is stored in the non-volatile memory and is not accidentally cleared.

A second example of a preferred embodiment of the present invention is explained hereinafter referring to FIGS. 4 through 6. The same numerals represent same elements as in the previous example of the present invention, and an explanation is omitted for the same elements in each of the examples described below. Especially, the device construction of the digital copying machine 1 to which this second example is applied is the same as shown in FIGS. 1 through 3.

Figure 4:
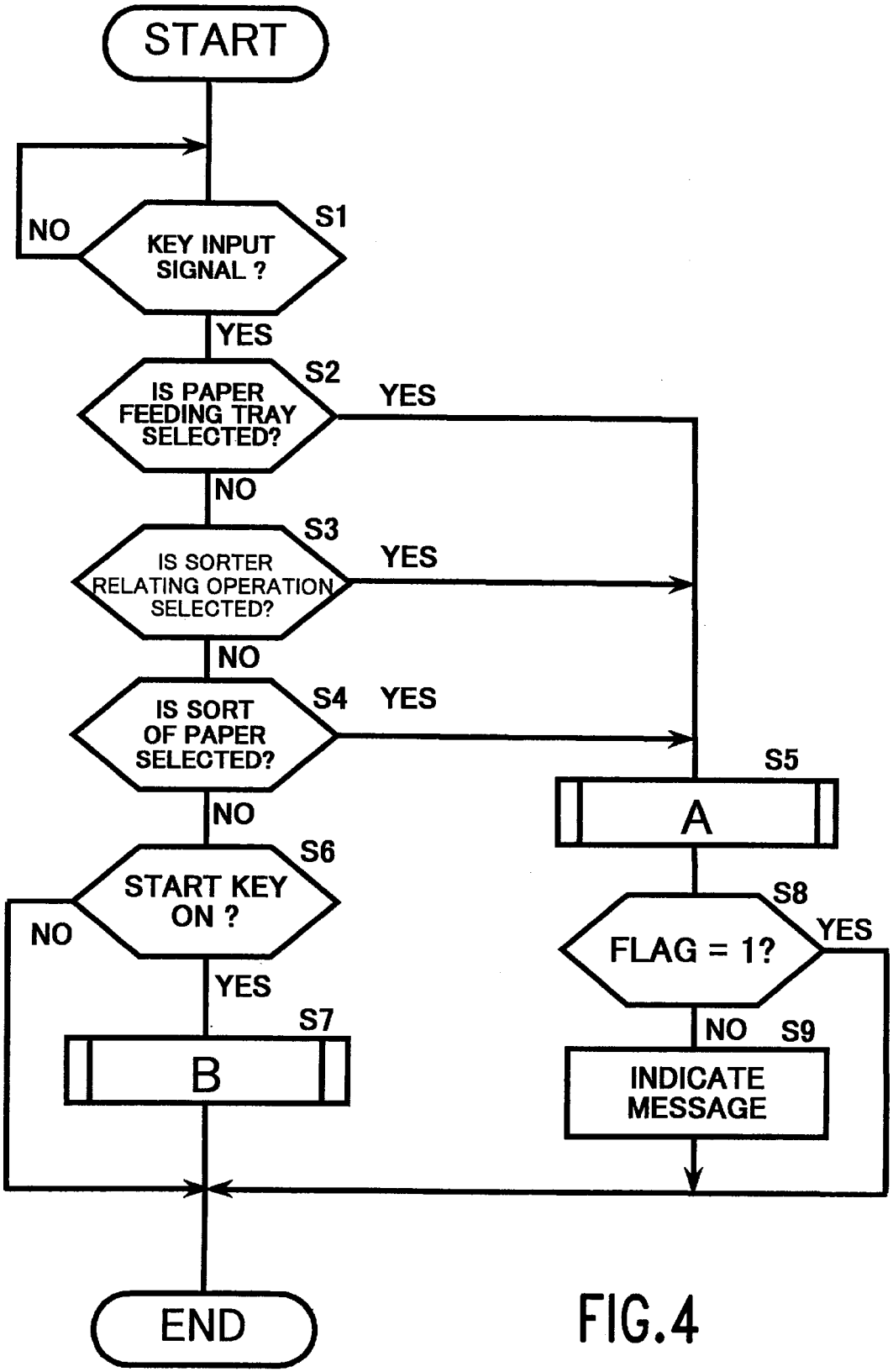
FIG. 4 is a flowchart showing a second example of the present invention.
Figure 5:
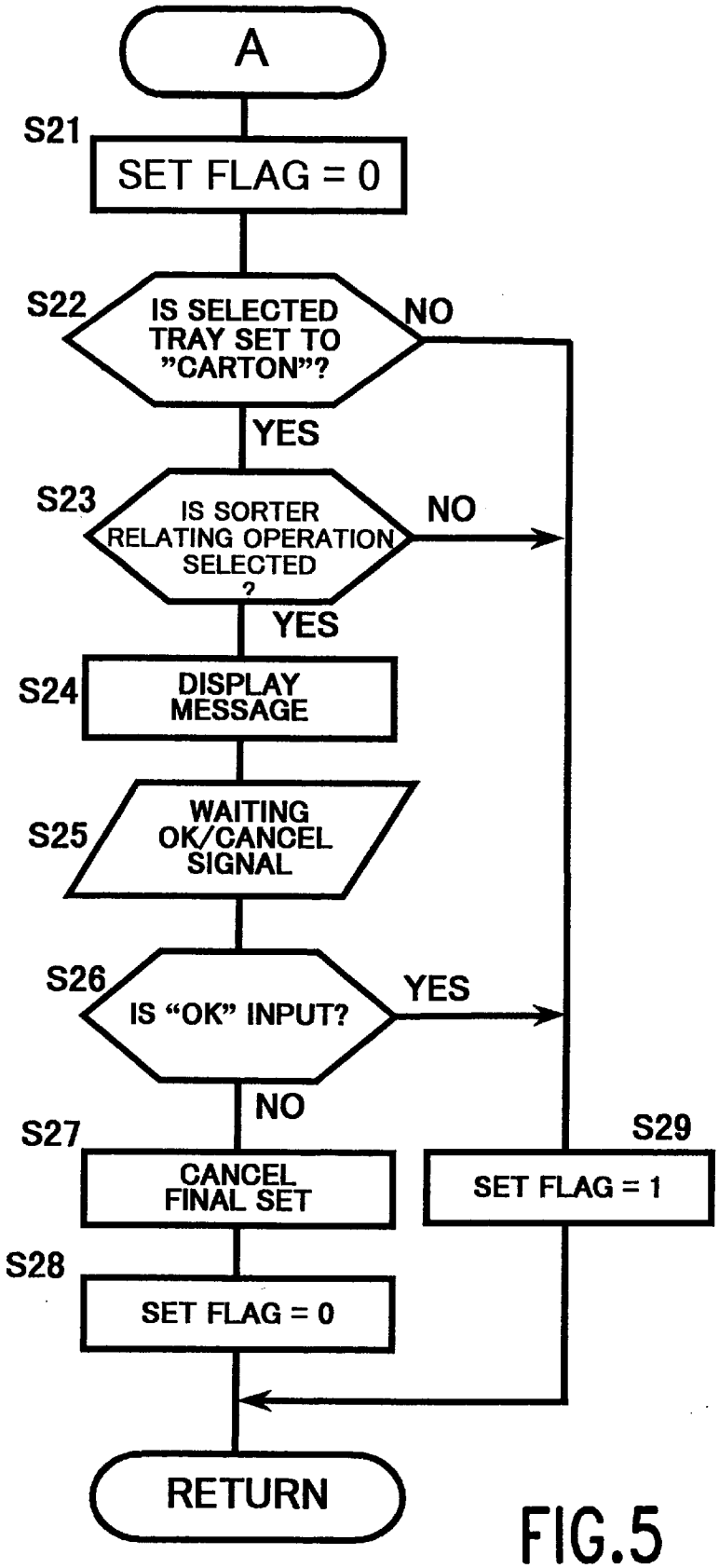
FIG. 5 is a flowchart showing a process A in FIG. 4.
Figure 6:
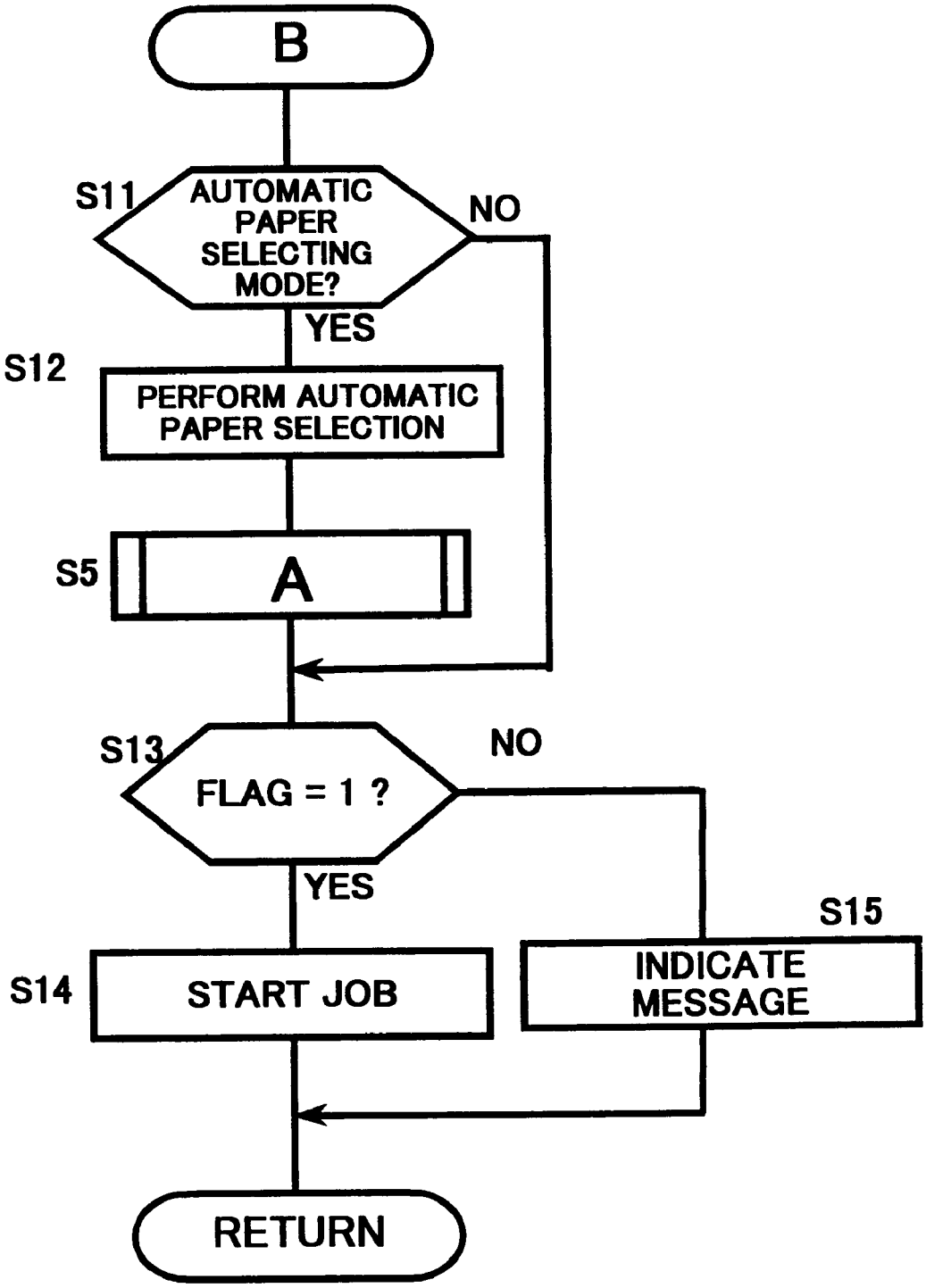
FIG. 6 is a flowchart showing a process B in FIG. 4.

This second example relates to a control process that is performed by the CPU 31 along with each kind of key operation, and the process according to the flowchart shown in FIG. 4 shows a condition for performing the processes shown in FIG. 5 and FIG. 6. Namely, the process surely starts an operation thereof when any one of the key-operations on the operation panel 5 is performed in a copy-waiting state (Step S1).

In the process shown in the flowchart in FIG. 4, a process (process A) shown in FIG. 5 is performed (Step S5) every time when any one of the key-operations select the front paper-feeding tray 7 or 8 by an operation of the tray selecting key 47*b* or 47*c* (Yes in Step S2). A sorter related processing such as a sort, stack, or staple is selected on the basis of the operation of the sorter related key 47*d* (Step S3), or the sort-of-paper selection, and a setting operation is selected on the basis of an operation of the sort-of-paper setting key 44, or the sort-of-paper keys 47*e* through 47*g* (Step S4). In addition, when the start key 41 is pressed down in Step S6 (Yes in Step S6), a process (process B) shown in the flowchart in FIG. 6 is performed.

Firstly, regarding the process B, referring to FIG. 6, in the automatic paper selecting mode (Yes in Step S11) based on the operation of the automatic paper selecting key 47*a*, the start key 41 is pressed down. Thereafter, an automatic paper selecting process (Step S12) selects the front paper-feeding tray at first if a paper of a size matching the required size to be copied is in the tray for the plain paper. On the other hand, if the paper of the size matching the required size to be copied does not exist, a process A shown in a flowchart in FIG. 5 is started (Step S5).

In process A in FIG. 5, the predetermined flag for permitting the start of the job is initially reset (Step S21), and when the "carton" (hereinafter the "carton" includes the "special paper" unless otherwise specified) is not set to the selected front paper-feeding tray 7 or 8 (No in Step S22), the aforementioned flag is set to "1" and the program in FIG. 4 ends (Step S29 and Step S8). Similarly, in a case that the "carton" is set to the selected front paper-feeding tray 7 or 8 (Yes in Step 22), if the sorter related operation such as sort, stack, staple or the like is not selected (No in Step S23), the flag also is set to 1 and the process in FIG. 4 ends (Step S29 and Step S8).

On the other hand, when the "carton" is set to the selected front paper-feeding tray 7 or 8 (Yes in Step S22), and the sorter related operation such as sort, stack, and staple is selected (Yes in Step 23), a warning message such as "if a carton or special paper is conveyed through the sorter, paper jamming may occur" is displayed at the display part 46 of the liquid crystal panel 6 (Step S24), and then the program is in a state of waiting for inputting "OK" or "Cancellation" (Step S25). Step S24 is performed as a function of a reporting device. Hereupon, when the "OK" key is pressed down (Yes in Step S26), the program sets the flag "1" and ends the process in FIG. 4 (Step S29 and Step S8). When the "Cancellation" key is pressed down (No in Step S26), the final setting is canceled (Step S27) and the flag is reset (Step S28). Thus, when the flag is reset (No in Step 8), for example, a message, "Setting is canceled" is displayed at display part 46 (Step S9).

On the other hand, when the start key 41 is pressed down in Step S1, the aforementioned process B shown in FIG. 6 is performed. However, if the flag is set to "1" finally (Yes in Step S13), the job (copying operation) starts in accordance with the setting condition (Step S14). On the other hand, if the flag is finally set to "0" (No in Step S13), a message "Job is canceled" is displayed to the display part 46 (Step S15), and the program ends.

Therefore, in accordance with this example, when the paper-discharging to the sorter 20 from the front paper-feeding tray 7 or 8 on which a carton or other special paper is set to be stacked is selected (Yes in Step S22, and Yes in Step S23), the user is noticed to confirm whether or not the selection is suitable by displaying a message for admonishing, and the user can then prevent a trouble such as paper janmming or the like to occur.

Figure 7:
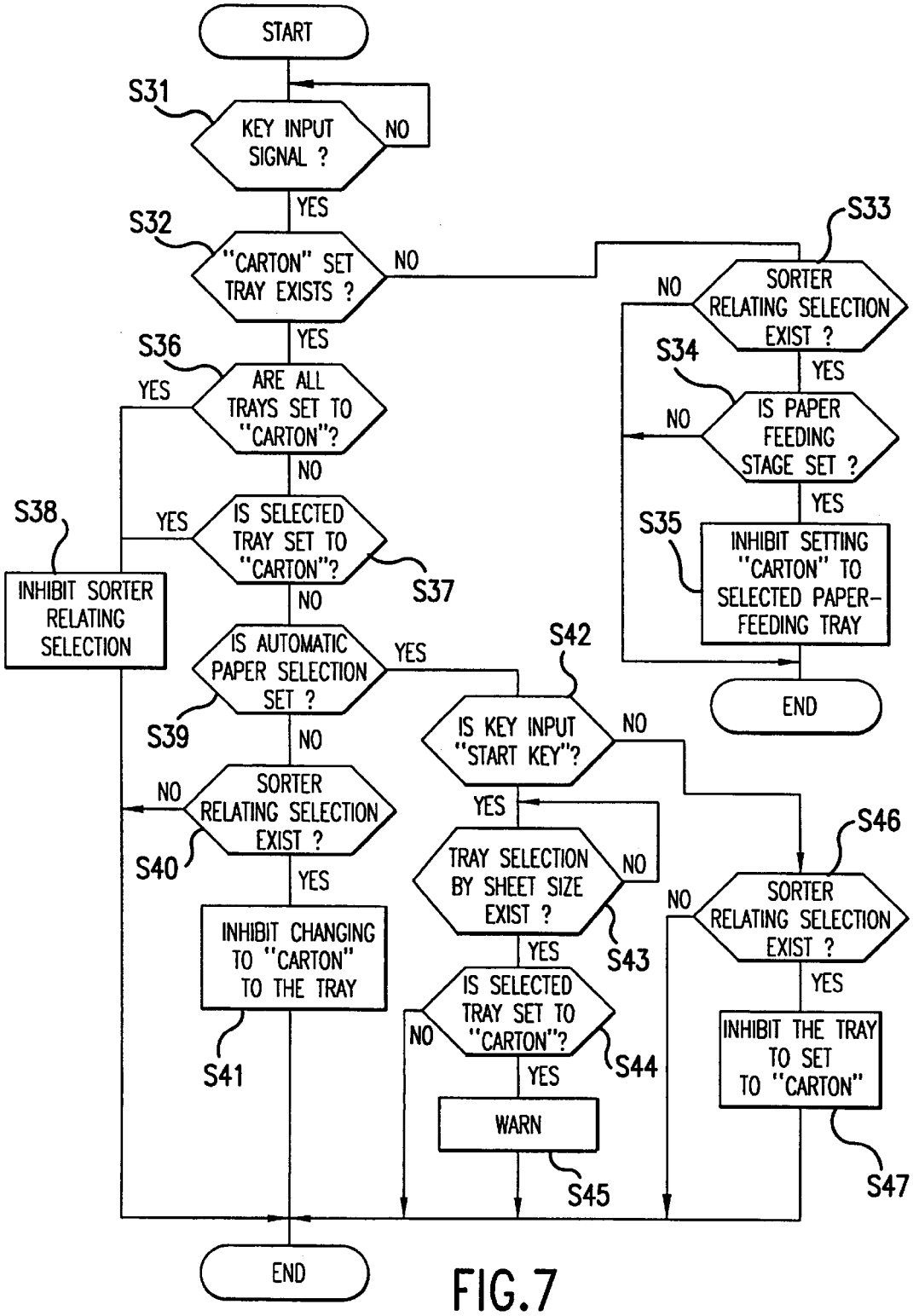
FIG. 7 is a flowchart showing a third example of the present invention.

A third example of a preferred embodiment of the present invention is explained with reference to FIG. 7. This example relates to a control process performed by the CPU 31 along with each sort of key operation, which is the same as in the aforementioned second example, and especially, a selection inhibiting process or the like at the key operation is a main process. This process surely starts when any one of the key operations on the operation panel is performed in a copy waiting state (Yes in Step S31).

The controller (CPU 31) judges whether the front paper-feeding tray on which the carton is set exists (Step S32). If not (No in Step S32), whether the sorter related process is selected and set is judged (Step S33). If the sorter related process is set (Yes in Step S33), the controller further judges whether the paper-feeding tray is set by the key 47*b* or 47*c* (Step S34). If the paper-feeding tray is set (Yes in Step S34), regarding the front paper-feeding tray 7 or 8 of the set paper-feeding tray, the setting for carton or the like is inhibited (Step S35). Namely, under the condition of selecting a specified paper-feeding tray and a sorter related process, a special type paper is inhibited to be selected and set.

On the other hand, if there is the "carton" in the front paper-feeding tray (Yes in Step S32), the controllerjudges whether the "carton" is set in all the front paper-feeding trays 7 and 8 in Step S36. If the answer is No in Step S36, the operation proceeds to Step S37 and judges whether the "carton" is set to one of the paper-feeding trays that is selected by the key 47*b* or the key 47*c* in Step S37. If the answers are Yes in Step S36 or Step S37, the program proceeds to Step S38 and the controller inhibits the selection of the sorter related process. Namely, in a case that the paper fed from the paper-feeding section is a special type paper such as the carton or the like, the selection setting of the sorter related process is inhibited, and accordingly, a mode setting for discharging the special paper to the sorter 20 side is prevented.

On the other hand, if the answers in steps S36 and S37 are No, and an automatic paper selecting mode is not set (No in Step S39), the operation proceeds to Step S40. The controller then judges whether the sorter related process is selected in Step S40. If the answer is Yes in Step S40, the selection change for the tray to which the "carton" is set is inhibited, or setting of the "carton" to the paper-feeding tray that is selected is inhibited (Step S41).

When the automatic paper selecting mode is set with the automatic paper selecting key 47*a*, while the answer is No in Steps S36 and S37 (and Yes in Step S39), and further the start key 41 is pressed down (Yes in Step S42), the controller judges whether the selected paper-feeding tray is the one in which the "carton" is set (Step S44), after operating the selection as usual for the paper-feeding tray corresponding to the paper size on the basis of the automatic paper selecting function (Step S43). If the paper-feeding tray is not the one in which the "carton" is set (No in Step S44), the controller performs the copying operation continuously, and if the paper-feeding tray is the one in which the "carton" is set (Yes in Step S44), the controller indicates a warning to the display part 46 (Step S45) and the program ends. The warning indication is, for example, "Carton is in the selected tray of the paper size. If the carton is passed through the sorter, a paper jamming may occur. Please change the paper to the plain paper". Further, if the tray is in a state before pressing the start key 41 down (No in Step S42), the controller judges whether the sorter relating process is selected (S46), and if selected, (Yes in Step S46), the setting of the carton or special paper or the like for the paper-feeding tray is inhibited (Step S47).

In this example, the Steps S35, S41, and S47 are performed as a function of a selection-invalidating device.

Accordingly, in this example, when the sorter related process is selected, and when the paper-feeding operation from the front paper-feeding tray 7, 8 in which the "carton" is set is selected, the selection is invalidated (inhibited). Therefore, an occurrence of paper jamming can be prevented, since the discharging operation of the paper from the front paper feeding tray 7, 8 in which the carton or the like special paper is set to be stacked to the sorter side is prevented. On the contrary, if it is the case that the front paper feeding tray 7, 8 is one in which the "carton" is set, the carton or other special paper which is fed is prevented from discharging to the sorter 20 side, since the selection for the sorter related process is inhibited.

Further, in this example, when the automatic paper selecting mode is set, the front paper feeding tray in which the "carton" is set may be controlled to be omitted from the object of selection.

Figure 8:
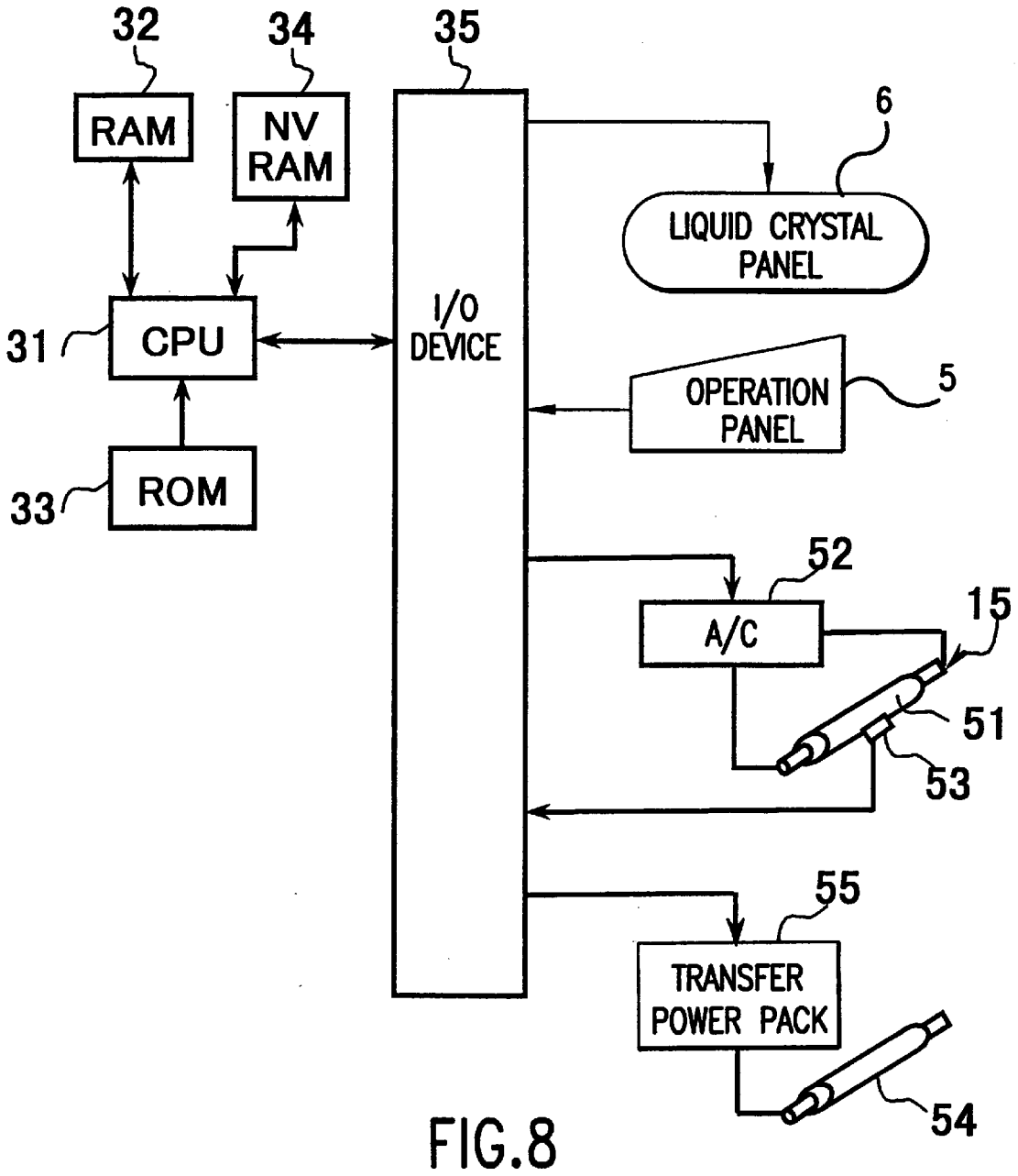
FIG. 8 is a block diagram of a control system showing a fourth example of the present invention.
Figure 9:
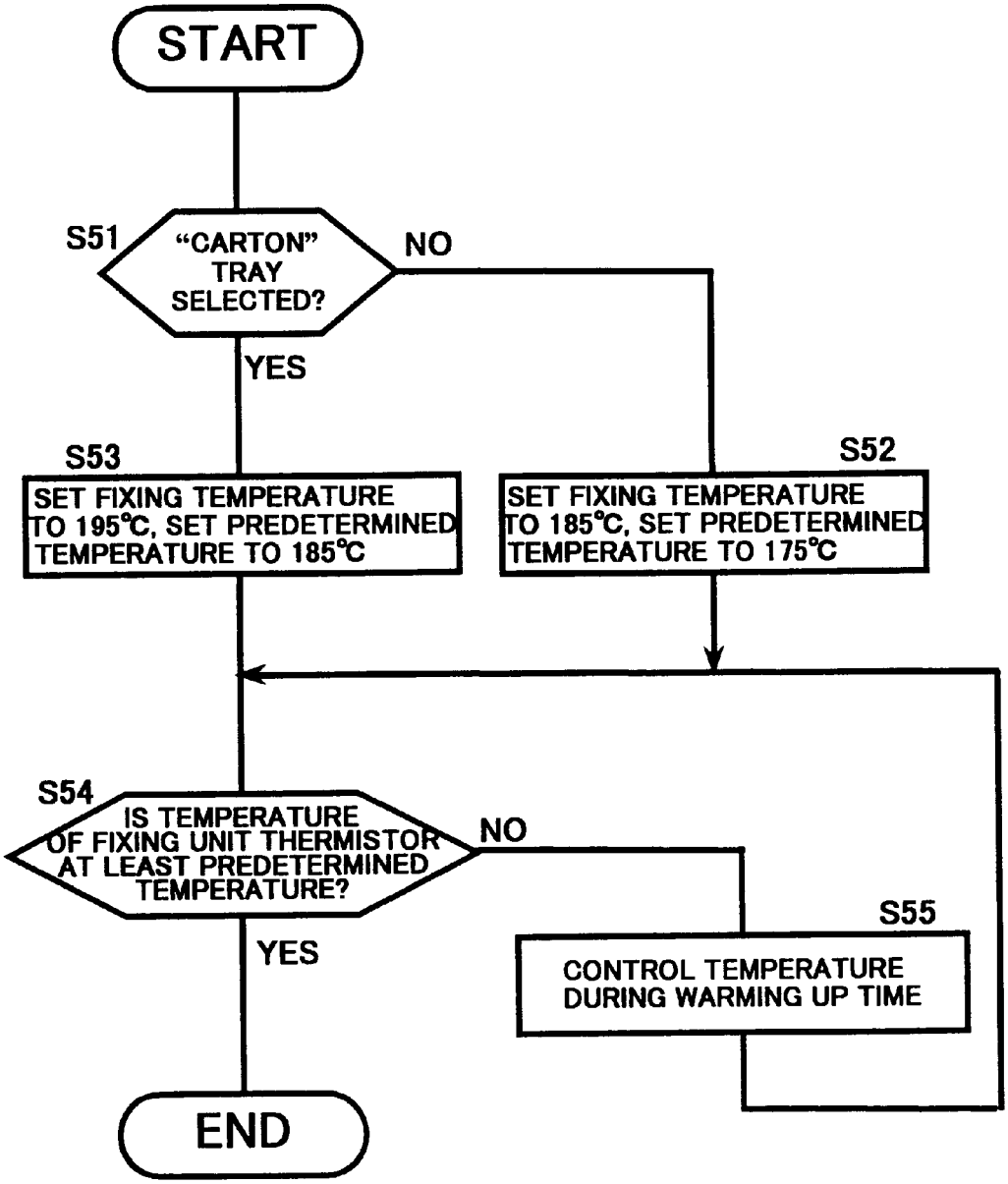
FIG. 9 is a flowchart showing a control process of the fourth example of the present invention.

A fourth example of a preferred embodiment of the present invention is explained referring to FIGS. 8 and 9. FIG. 8 is a block diagram showing a construction of a control system of this example. First, an AC power source 52 that functions as a temperature changing device for heating the heater in a fixing roller 51 in the heat fixing device 15 by energizing the heater and a thermistor 53 that detects the temperature of the fixing roller 51 are connected to an I/O device 35. In addition, a transfer power pack 55 that functions as an image forming condition changing device by supplying a transfer current to a transfer roller 54 in the image forming device 12 is also connected to I/O device 35.

The process shown in FIG. 9 is performed when the front paper feeding tray 7 or 8 is selected and set by manual operation with the sort-of-paper keys 47*e* or the like, or when a similar operation is performed with the automatic paper selecting mode. First, the controller judges whether the selected front paper-feeding tray 7 or 8 is the one in which the "carton" is set (Step S51). If the front paper-feeding tray is not the one in which the "carton" is set (No in Step S51), a fixing set temperature and the predetermined temperature are respectively set to, e.g., 185° C. and 175° C. as usual temperatures (Step S52). Hereupon, the "predetermined temperature" is a rising edge temperature of the fixing roller 51 for limiting an operation not to press down the start key 41 before the temperature rises up to the fixing temperature. The predetermined temperature is set, considering the time at which the fed paper reaches the heat fixing device 15. On the other hand, if the front paper-feeding tray is the one in which the "carton" is set (Yes in Step S51), the fixing set temperature and the predetermined temperature are respectively changed from the usual temperatures of 185° C. and 175° C. to, for example, 195° C. and 185° C. respectively (Step S53). Thereafter, whichever temperatures are set, the temperature control for a warming up period is performed by intermittently energizing the heater so that the fixing temperature is maintained within a steady temperature under the control of the thermistor 53 as in a usual waiting state (Step S54 and Step S55).

Accordingly, in a case of forming an image by feeding the "carton", since the fixing temperature of the heat fixing device 15 is changed to a value higher than a usual fixing temperature, the appropriate fixing process corresponding to the sort of paper is performed.

Further, even though it is not shown in the drawings, in a case that the selected paper feeding tray is the one in which the "carton" is set (Yes in Step S51), formation of a poor image can be prevented if the image is formed in a state of set values of a transfer current being changed by sending a control signal to the transfer power pack 55 (a change of an image forming condition). Namely, if the same transfer current as to the plain paper is applied to the carton or other special papers, the transfer efficiency may be decreased, however, the aforementioned operations can prevent this problem.

Figure 10:
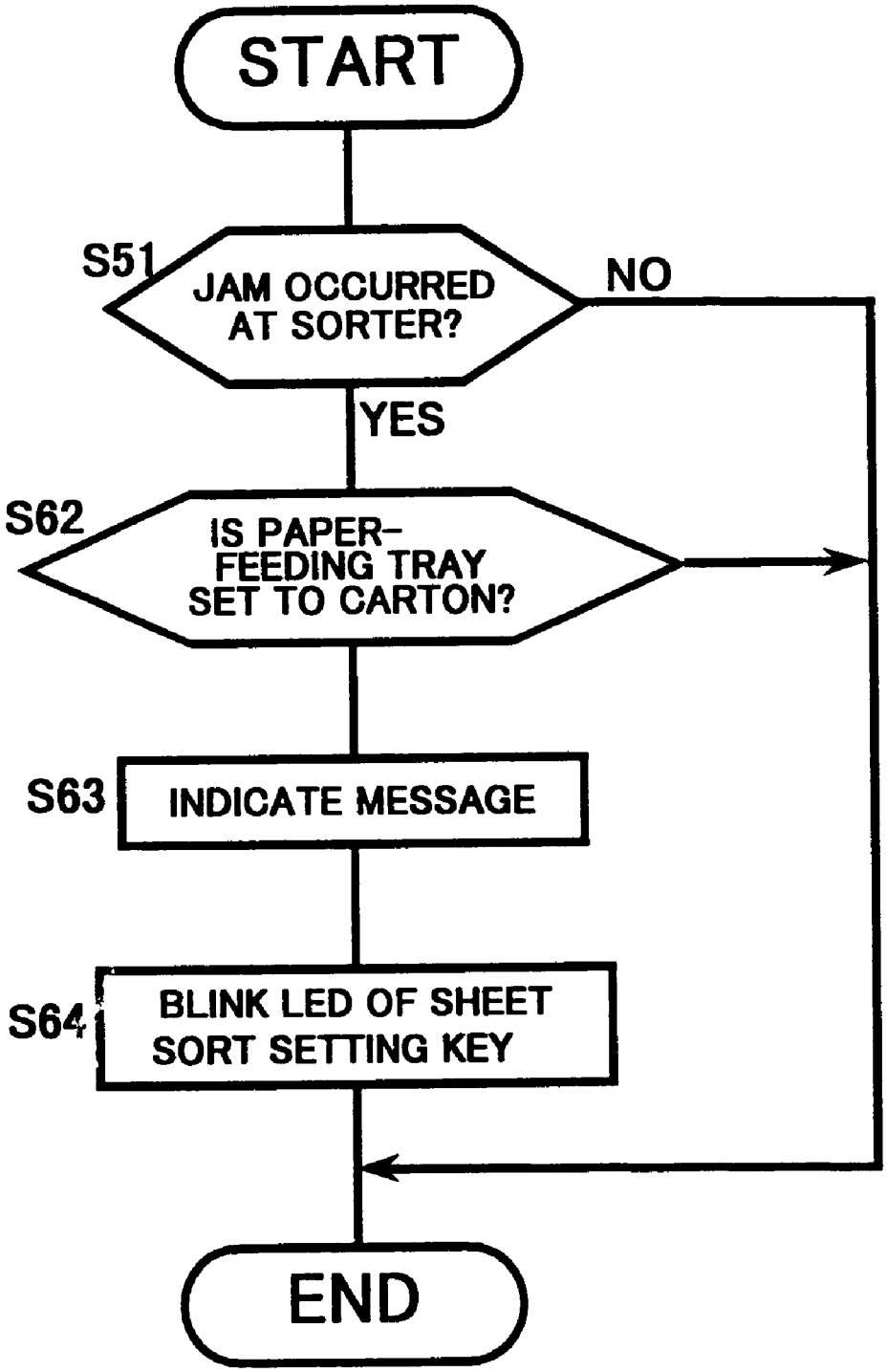
FIG. 10 is a flowchart showing a fifth example of the present invention.

A fifth example of a preferred embodiment of the present invention is explained referring to FIG. 10. A construction of this example (though not shown) relates to a control process in a case of a paper jamming occurring under any well known paper jamming detecting mechanism, especially at the sorter section 20. The process shown in the flowchart in FIG. 10 is performed when a paper jamming has occurred at the sorter related peripheral device, for example, in the sorter 20 (Yes in Step S61). When the paperjamming has occurred in the sorter 20, the program judges whether the "carton" is set in the used front paper feeding tray 7 or 8 (Step S62). If the "carton" is set (Yes in Step S62), since the control in the other examples described above operates, the process shown in FIG. 10 ends. On the other hand, if the "carton" is not set (No in Step S62), since there is a possibility that the user has forgotten to set the "carton", in spite of stacking the "carton" in the paper feeding tray in fact, even though the setting state is "plain paper", the controller indicates a message at the display part 46, and admonishes the user of the erroneous operation. This indication of the message is, for example, "Please confirm whether the paper supplied is a carton/special paper. If a carton/special paper, please reset the sort of paper". An attention of the user for the sort-of-paper setting operation can be aroused by blinking the indication lamp 45 (Step S64) by the side of the sort-of-paper setting key 44. Hereupon, the Step S64 is performed as a function of the reporting device.

In accordance with this example, when the paper jamming has occurred at the paper-discharging peripheral device, such as the sorter 20 or the like, the user can easily judge whether the cause of the paper jamming is that the user has forgotten to set the paper as a carton or special paper or the like, and the user can then adopt appropriate measures.

Further, the aforementioned examples are explained in consideration of using the sorter 20 as a paper-discharging peripheral device. However this invention can be applied to another selection of a paper-discharging peripheral device such as a duplex copying unit, a finisher, a mail-box, or the like, in the same manner. Furthermore, as an example of a reporting device, this example has explained the message display at the display part 46 of the liquid crystal panel 6. However, a voice message can also be used for the reporting device. If the present invention is applied to a printer or the like, these displays or a voice message may be constructed for sending a message to a server and a personal computer that requires an output.

Furthermore, an operation panel 5 is provided in the scanner part 2 in this example. However, the operation panel 5 may be attached on a plotter part 3 side.

Figure 11:
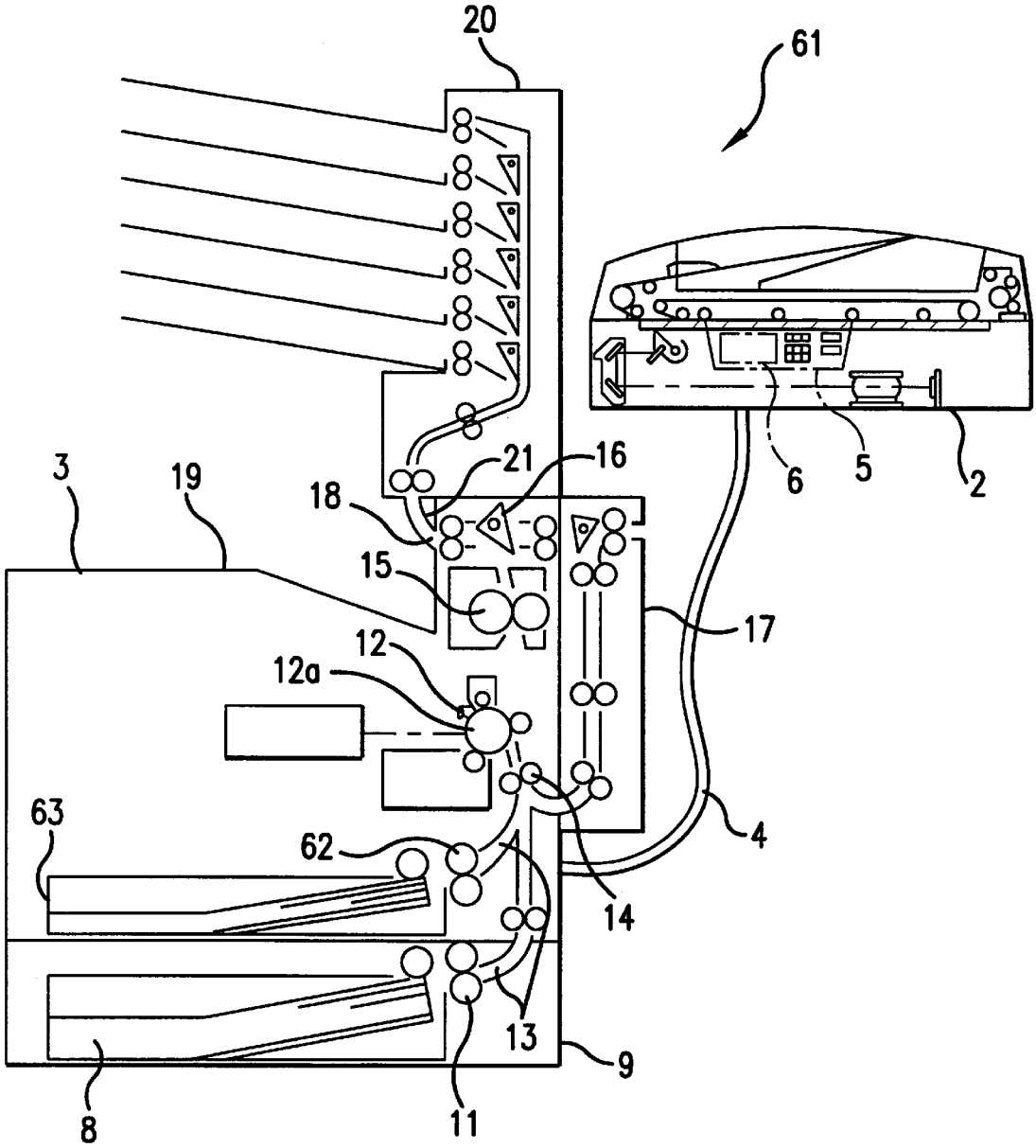
FIG. 11 is a vertical section showing a schematic construction of a digital copying machine of a sixth example of the present invention.
Figure 12:
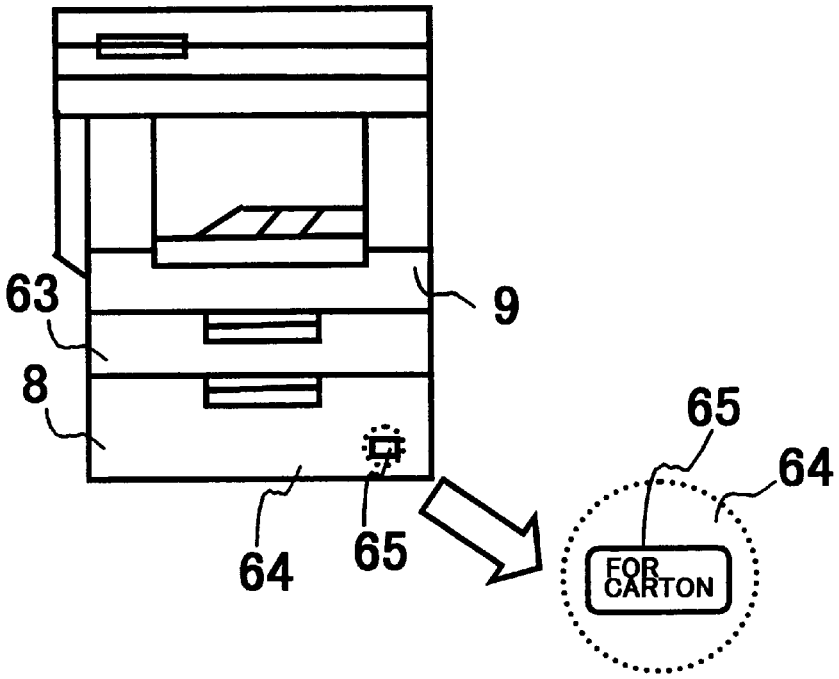
FIG. 12 is an elevation of a plotter showing an enlarged part.
Figure 13:
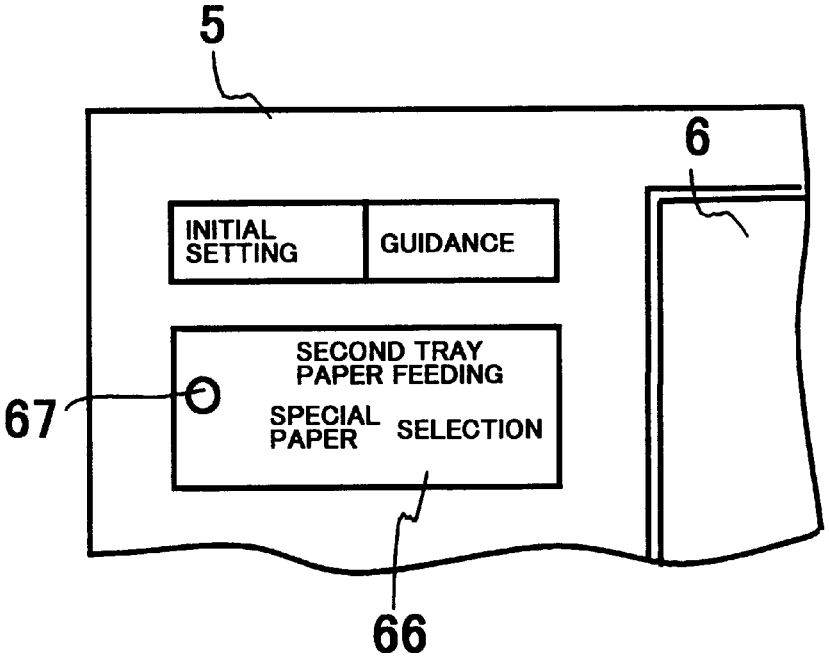
FIG. 13 is a top plan view showing a part of an operation panel.

A sixth example of a preferred embodiment of the present invention is explained referring to FIGS. 11 through 13. In a digital copying machine 61 of this present example, in comparison with the aforementioned digital copying machine 1, only the front paper feeding tray 8 in two paper feeding trays is provided with a separation paper feeding mechanism 11 that can feed papers regardless of the sort-of-paper. The upper tray of the digital copying machine 61 is a front paper feeding tray 63 only for plain paper and has a simple separation paper-feeding mechanism 62 of a corner pick separation system, a friction pad system, etc. In this case, since the construction around the front paper feeding tray 63 is made thin and simple, an entire height of the main body of the image forming apparatus 9 is slightly less in comparison with the digital copying machine 1. In addition, for example, a denotation 65 such as "for carton" is displayed with a distinctive color different from that of a front panel 64 at a part of the front panel 64 of the front paper feeding tray 8 as shown in FIG. 12, for designating to the user that only the lower front paper feeding tray 8 is capable of use for plain paper, a carton, or the like, and all kinds of paper regardless of the sort-of-paper.

Corresponding to the construction having only one front paper feeding tray 8 that can feed paper regardless of the sort-of-sheets, a carton and a special paper selecting key 66 for the second tray 8 is provided as a single key as a setting device replacing the paper setting key 44 on the operation panel 5, as shown in FIG. 13. This selecting key 66 can be a toggle switch that repeats the "setting" and "canceling" operation in every pressing motion. Further, an indication lamp 67 of the LED construction that corresponds the indication lamp 45 can be built-in in the selecting key 66.

Accordingly, in this example, the tray in which the special type papers such as the carton can be set is only the front paper-feeding tray 8 at the lower part, and when the carton or the like is stacked in the front paper feeding tray 8, the state that the special paper is stacked can be set by only pressing the special paper selecting key 66 for the second tray 8 once on the operation panel 5. When the state of the second tray 8 is of the setting state, the user can recognize the state according to the lighting of the indication lamp 67. When returning to the selection of the plain paper, the user need only re-press the special paper selecting key 66 for the second tray again. This embodiment provides benefits as special paper such as a carton is generally used with less frequency than plain paper, and in addition, to use a special papers setting in both of two front paper feeding trays is quite a rare case, and thus in this embodiment the front paper feeding tray that can feed the paper regardless of the sort-of-paper is limited to only one tray 8 because this will not result in any special inconvenience in practice. As a result, the carton can be set with only a single key operation as a merit.

Further, the aforementioned second through fifth examples and the modifications thereof can be applied to this sixth example.

Figure 14:
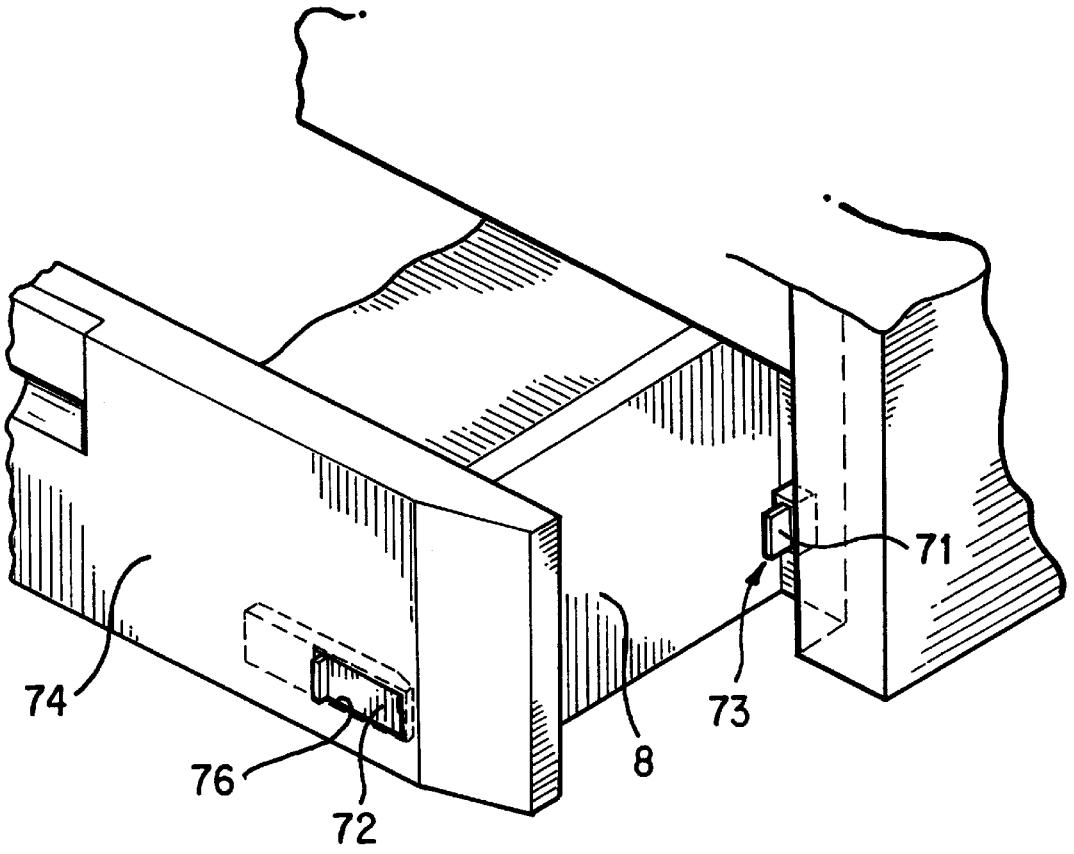
FIG. 14 is a perspective view around a paper-feeding tray showing a seventh example of the present invention.

A seventh example of a preferred embodiment of the present invention is explained referring to FIGS. 14 and 15. The setting device is provided on the operation panel 5 in the aforementioned first or sixth example, so that the "carton" is set. However, in this example, the "carton" is set around a front paper feeding tray.

Figure 15A:
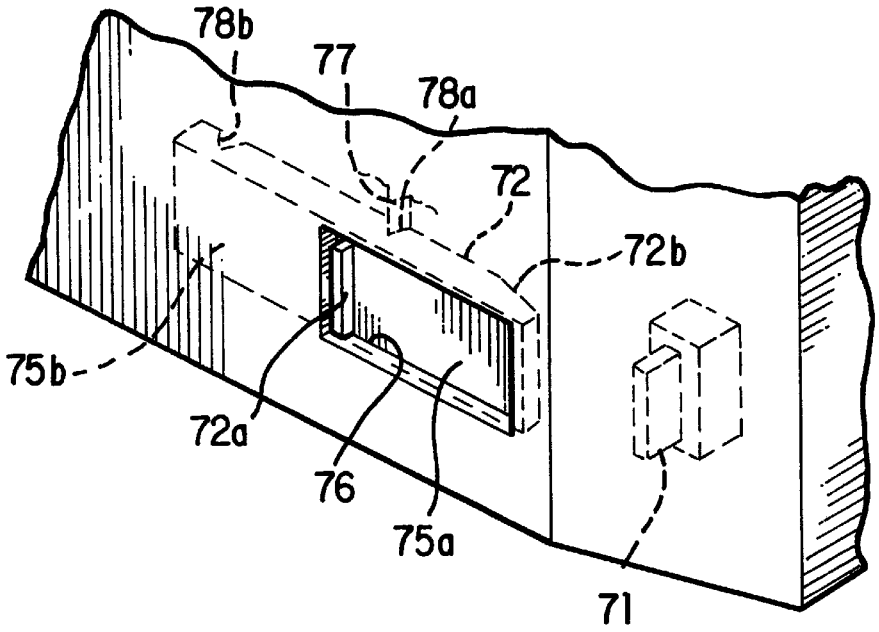
FIGS. 15A and 15B are perspective views showing an enlarged part of the paper-feeding tray in FIG. 14.
Figure 15B:
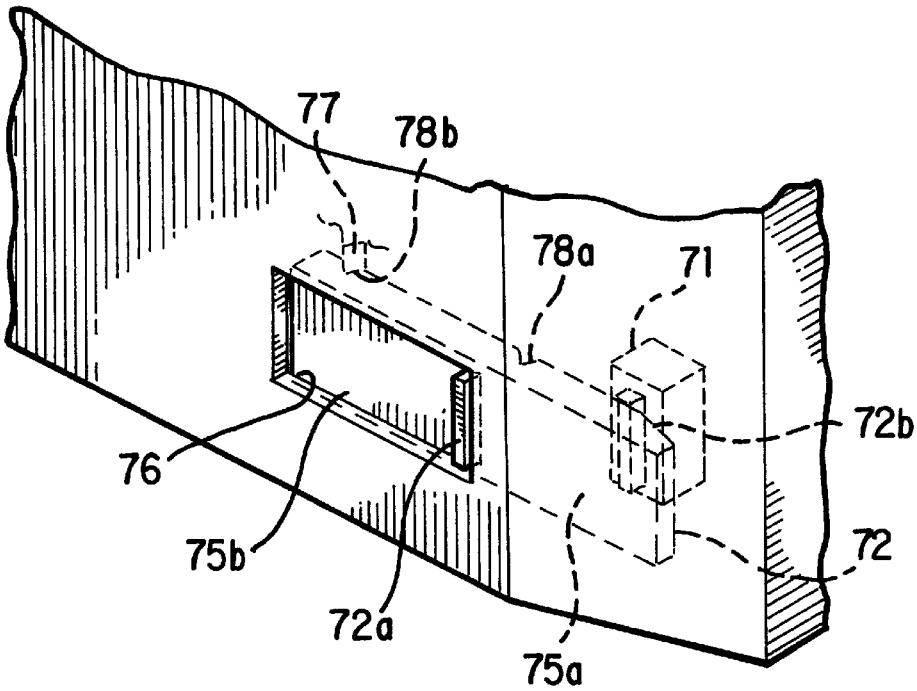

Hereupon, this example is explained with the front paper-feeding tray 8. The setting device for setting the "carton" in this example is constructed with a switch 73 composed of a push sensor 71 provided at a predetermined position in the main body of the image forming apparatus and a slide lever 72 for limiting a turning on and off of the push sensor 71, which is provided at a part of the front paper feeding tray 8. The slide lever 72 is mounted slidably in a direction to the right and left at one end side in a front panel 74 of the front paper feeding tray 8. A denotation 75*a* as "plain paper" is provided at a right half part, and another denotation 75*b* as "carton/special paper" is provided at a left half part. The central part of the denotations is formed as a projection for a slide knob. A window 76 for exposing either one of the denotations 75*a* and 75*b* is formed at the front panel 74. Further, as shown in FIGS. 15A, 15B, two hooking grooves 78*a* and 78*b* can be provided for deciding the position of the slide lever 72 by selectively hooking the same to a hooking rib 77 that is formed at the tray housing. The slide lever 72 is positioned so that the denotation 75*a* of the "plain paper" can be seen from the window 76 in a state of the hooking groove 78*a* hooked at the hooking rib 77, and the denotation 75*b* of the "carton/special paper" can be seen from the window 76 in a state of the hooking groove 78*b* hooked at the hooking rib 77.

The aforementioned push sensor 71 is positioned so that the slide lever 72 can press the same when the front paper feeding tray 8 is pressed into the main body 9 of the image forming apparatus in a state of the hooking groove 78*b* that is hooked at the hooking rib 77. On the contrary, the push sensor 71 is positioned so that the slide lever 72 does not press the same, if the hooking groove 78*a* is hooked at the hooking rib 77, even though the front paper feeding tray 8 is pressed into the main body 9 of the image forming apparatus. On the other hand, an end of the slide lever 72 for pressing the push sensor 71 can have a slanting surface so that the slide lever 72 can be slid to the right side when the front paper feeding tray 8 is pressed into the main body of the image forming apparatus.

In accordance with this example, in a case of setting the carton or other special paper into the front paper feeding tray 8, the setting operation for the special paper can be performed by operating the sort-of-paper setting by sliding the slide lever 72 towards the right with the operation of stacking the special paper. At a side of CPU 31, it is recognized that when the push sensor 71 is in a turned-on state, the special paper is stacked in the corresponding front paper feeding tray, and when the push sensor 71 is in a turned-off state, the plain paper is stacked in the corresponding front paper feeding tray. This information is used for the aforementioned control. Especially, since the setting for the special paper can be operated around the front paper feeding tray 8 where the exchange and setting of the paper is actually operated, working efficiency is good and mis-setting can be decreased.

Further, the control process can basically be applied to this example in the same manner as to the aforementioned second through fifth examples, however, the control process should be slightly modified. For example, at the control processes in FIGS. 4 through 6, when the user has performed a canceling operation on the operation panel 5 (No in Step S26), the final setting is determined to be canceled (Step S27). However, in this example, since the setting operation is mechanically performed by the operation of the slide lever 72, the setting of sorter related process can be controlled to be canceled. The reason why the setting of the paper feeding tray is not canceled is that if the final operation of the user is setting the carton to the paper feeding tray, the user is considered to require a copy using the carton with the paper feeding tray in a high possibility. Further, regarding the control process shown in FIG. 7, in this example, since the control for inhibiting the setting of the "carton" becomes complex in mechanism, the message of the cancellation may be indicated to the display part 46 after canceling the setting of the selection of the sorter related process, only when the "carton" is set finally after satisfying each sort of condition other than inhibiting the setting of the "carton".

The controller of this invention may be conveniently implemented using a conventional general purpose digital computer or microprocessor programmed according to the teachings of the present specification, as is apparent to those skilled in the computer technology. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Obviously, numerous additional modifications and variations of the present invention are possible in light of the above teachings. It is therefore to be understood that within the scope of the appended claims, the present invention may be practiced otherwise than as specifically described herein.

Having now fully described the present invention, it will be apparent to one of ordinary skill in the art that many changes and modifications can be made thereto without departing from the spirit and scope of the present invention as set forth herein.

This application is based on Japanese Patent Application No. JPAP09-199665, filed on Jul. 25, 1997, the entire contents of which are herein incorporated by reference.

I claim:

1. An image forming apparatus comprising:

an image forming device that forms an image on a paper;

a paper-feeding tray contained in a main body of said image forming apparatus, wherein a plurality of papers can be stacked on the paper-feeding tray;

a conveying path conveying the paper in said paper-feeding tray to said image forming device;

a setting device setting a sort-of-paper when a special paper other than a plain paper is stacked in said paper-feeding tray, wherein said setting device sets the sort-of-paper with a key operation on an operation panel, and wherein the paper-feeding tray is provided with a separation paper-feeding mechanism feeding the special paper and plain paper stacked on said paper-feeding tray;

a peripheral device for a paper-discharging operation to which the paper on which the image is formed by said image forming device is discharged;

a first selection device for the paper-discharging operation that selects the paper discharging operation of the paper to said peripheral device;

a second selection device for a paper-feeding operation that selects a paper feeding operation of the paper from said paper-feeding trays; and a reporting device that notifies to re-confirm whether or not the selection of the paper-feeding tray is correct when the paper-feeding operation from said paper-feeding tray indicates that special paper is set by said setting device, while the discharging operation of the paper to said peripheral device is selected by said first selection device for the paper-discharging operation.

2. The image forming apparatus according to claim 1, wherein a cancellation device canceling the sort-of-paper of the special paper set by said setting device is provided on the basis of a re-setting operation.

3. The image forming apparatus according to claim 1, further comprising:

a fixing device that fixes the image formed on the paper by the image forming device; and a temperature changing device that changes a fixing set temperature at said fixing device when a special type of paper is set as a sort-of-paper by a setting device.

4. The image forming apparatus according to claim 1, further comprising:

an image forming condition changing device that changes an image forming condition of said image forming device when the special type paper is set as a sort-of-paper by a setting device.

5. An image forming apparatus, comprising:

an image forming device that forms an image on a paper;

a paper-feeding tray contained in a main body of said image forming apparatus, wherein a plurality of papers can be stacked on the paper-feeding tray;

a conveying path conveying the paper in said paper-feeding tray to said image forming device;

a setting device setting a sort-of-paper when a special paper other than a plain paper is stacked in said paper-feeding tray, wherein said setting device sets the sort-of-paper with a key operation on an operation panel, and wherein the paper-feeding tray is provided with a separation paper-feeding mechanism feeding the special paper and plain paper stacked on said paper-feeding tray;

a peripheral device for a paper-discharging operation to which the paper after the image is formed thereon by said image forming device is discharged;

a first selection device for the paper discharging operation that selects the paper-discharging operation of the paper to said peripheral device;

a second selection device for a paper feeding operation that selects a paper-feeding operation from said paper-feeding trays; and a selection invalidating device invalidating the selection of said paper-feeding tray, when the paper-feeding operation from said paper-feeding tray indicates that special paper is set by said setting device, while the discharging operation of the paper to said peripheral device is selected by said first selection device for the paper-discharging operation.

6. The image forming apparatus according to claim 5, wherein a cancellation device canceling the sort-of-paper of the special paper set by said setting device is provided on the basis of a re-setting operation.

7. The image forming apparatus according to claim 5, further comprising:

a fixing device that fixes the image formed on the paper by the image forming device; and a temperature changing device that changes a fixing set temperature at said fixing device when a special type of paper is set as a sort-of-paper by a setting device.

8. The image forming apparatus according to claim 5, further comprising:

an image forming condition changing device that changes an image forming condition of said image forming device when the special type paper is set as a sort-of-paper by a setting device.

9. An image forming apparatus, comprising:

an image forming device that forms an image on a paper;

a paper-feeding tray contained in a main body of said image forming apparatus, wherein a plurality of papers can be stacked on the paper-feeding tray;

a conveying path conveying the paper in said paper-feeding tray to said image forming device;

a setting device setting a sort-of-paper when a special paper other than a plain paper is stacked in said paper-feeding tray, wherein said setting device sets the sort-of-paper with a key operation on an operation panel, and wherein the paper-feeding tray is provided with a separation paper-feeding mechanism feeding the special paper and plain paper stacked on said paper-feeding tray;

a peripheral device for a paper-discharging operation to which the paper on which the image is formed by said image forming device is discharged;

a selection device for the paper-discharging operation that selects the paper-discharging operation of the paper to said peripheral device;

a paper jamming detecting device that detects a paper jamming in said peripheral device; and a reporting device that notifies to confirm a sort-of-paper in said paper-feeding tray when the paper-discharging operation for discharging the paper to said peripheral device is selected by said selecting device for the discharging operation, and when paper jamming in said peripheral device is detected.

10. The image forming apparatus according to claim 9, wherein a cancellation device canceling the sort-of-paper of the special paper set by said setting device is provided on the basis of a re-setting operation.

11. The image forming apparatus according to claim 9, further comprising:

a fixing device that fixes the image formed on the paper by the image forming device; and a temperature changing device that changes a fixing set temperature at said fixing device when a special type of paper is set as a sort-of-paper by a setting device.

12. The image forming apparatus according to claim 9, further comprising:

an image forming condition changing device that changes an image forming condition of said image forming device when the special type paper is set as a sort-of-paper by a setting device.

13. An image forming apparatus, comprising:

image forming means for forming an image on a paper;

paper-feeding means contained in a main body of said image forming apparatus for feeding papers, wherein a plurality of papers can be stacked on the paper-feeding means;

conveying means for conveying the paper in said paper-feeding means to said image forming means;

setting means for setting a sort-of-paper when a special paper other than a plain paper is stacked in said paper-feeding means, wherein said setting means sets the sort-of-paper with a key operation on an operation panel, and wherein the paper-feeding means is provided with a separation paper-feeding means feeding the special paper and plain paper stacked on said paper-feeding means;

peripheral means for a paper-discharging operation to which the paper on which the image is formed by said image forming device is discharged;

a first selecting means for the paper-discharging operation for selecting the paper discharging operation of the paper to said peripheral device;

a second selecting means for a paper-feeding operation for selecting a paper feeding operation of the paper from said paper-feeding means; and a reporting means for notifying to re-confirm whether or not the selection of the paper-feeding means is correct when the paper-feeding operation from said paper-feeding means indicates that special paper is set by said setting means, while the discharging operation of the paper to said peripheral means is selected by said first selection means for the paper-discharging operation.

14. The image forming apparatus according to claim 13, wherein a cancellation means for canceling the sort-of-paper of the special paper set by said setting means is provided on the basis of a re-setting operation.

15. The image forming apparatus according to claim 13, further comprising:

fixing means for fixing the image formed on the paper by the image forming means; and temperature changing means for changing a fixing set temperature at said fixing means when a special type paper is set as a sort-of-paper by a setting means.

16. The image forming apparatus according to claim 13, further comprising:

an image forming condition changing means for changing an image forming condition of said image forming means when the special type paper is set as a sort-of-paper by a setting means.

17. The image forming apparatus, comprising:

image forming means for forming an image on a paper;

paper-feeding means contained in a main body of said image forming apparatus for feeding papers, wherein a plurality of papers can be stacked on the paper-feeding means;

conveying means for conveying the paper in said paper-feeding means to said image forming means;

setting means for setting a sort-of-paper when a special paper other than a plain paper is stacked in said paper-feeding means, wherein said setting means sets the sort-of-paper with a key operation on an operation panel, and wherein the paper-feeding means is provided with a separation paper-feeding means feeding the special paper and plain paper stacked on said paper-feeding means;

peripheral means for a paper-discharging operation to which the paper after the image is formed thereon by said image forming means is discharged;

a first selecting means for the paper discharging operation for selecting the paper-discharging operation of the paper to said peripheral device;

a second selecting means for a paper feeding operation for selecting a paper-feeding operation from said paper-feeding means; and a selection invalidating means for invalidating the selection of said paper-feeding means, when the paper-feeding operation from said paper-feeding means indicates that special paper is set by said setting means, while the discharging operation of the paper to said peripheral means is selected by said first selection means for the paper-discharging operation.

18. The image forming apparatus according to claim 17, wherein a cancellation means for canceling the sort-of-paper of the special paper set by said setting means is provided on the basis of a re-setting operation.

19. The image forming apparatus according to claim 17, further comprising:

fixing means for fixing the image formed on the paper by the image forming means; and temperature changing means for changing a fixing set temperature at said fixing means when a special type paper is set as a sort-of-paper by a setting means.

20. The image forming apparatus according to claim 17, further comprising:

an image forming condition changing means for changing an image forming condition of said image forming means when the special type paper is set as a sort-of-paper by a setting means.

21. The image forming apparatus, comprising:

image forming means for forming an image on a paper;

paper-feeding means contained in a main body of said image forming apparatus for feeding papers, wherein a plurality of papers can be stacked on the paper-feeding means;

conveying means for conveying the paper in said paper-feeding means to said image forming means;

setting means for setting a sort-of-paper when a special paper other than a plain paper is stacked in said paper-feeding means, wherein said setting means sets the sort-of-paper with a key operation on an operation panel, and wherein the paper-feeding means is provided with a separation paper-feeding means feeding the special paper and plain paper stacked on said paper-feeding means;

peripheral means for a paper-discharging operation to which the paper on which the image is formed by said image forming means is discharged;

a selecting means for the paper-discharging operation for selecting the paper-discharging operation of the paper to said peripheral means;

a paper jamming detecting means for detecting a paper jamming in said peripheral means; and a reporting device means for notifying to confirm a sort-of-paper in said paper-feeding means when the paper-discharging operation for discharging the paper to said peripheral means is selected by said selecting means for the discharging operation, and when paper jamming in said peripheral means is detected.

22. The image forming apparatus according to claim 21, wherein a cancellation means for canceling the sort-of-paper of the special paper set by said setting means is provided on the basis of a re-setting operation.

23. The image forming apparatus according to claim 22, further comprising:

fixing means for fixing the image formed on the paper by the image forming means; and temperature changing means for changing a fixing set temperature at said fixing means when a special type paper is set as a sort-of-paper by a setting means.

24. The image forming apparatus according to claim 22, further comprising:

an image forming condition changing means for changing an image forming condition of said image forming means when the special type paper is set as a sort-of-paper by a setting means.

* * * * *